US007489070B2

(12) United States Patent
Park et al.

(10) Patent No.: US 7,489,070 B2
(45) Date of Patent: Feb. 10, 2009

(54) FIELD EMISSION DEVICE AND FIELD EMISSION DISPLAY USING THE SAME HAVING A CONCAVE-SHAPED CATHODE TO ENHANCE ELECTRON FOCUSING

(75) Inventors: Young-Jun Park, Suwon-si (KR); Tae-Won Jeong, Seoul (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 576 days.

(21) Appl. No.: 11/194,559

(22) Filed: Aug. 2, 2005

(65) Prior Publication Data

US 2006/0028111 A1 Feb. 9, 2006

(30) Foreign Application Priority Data

Aug. 4, 2004 (KR) ..... 10-2004-0061422

(51) Int. Cl.
*H01J 1/62* (2006.01)
*H01J 63/04* (2006.01)

(52) U.S. Cl. ..... 313/495; 313/310; 313/497

(58) Field of Classification Search ..... 313/495–497, 313/310

See application file for complete search history.

(56) References Cited

U.S. PATENT DOCUMENTS

| | | | | |
|---|---|---|---|---|
| 5,920,151 | A | 7/1999 | Barton et al. | |
| 2004/0080260 | A1 * | 4/2004 | Park et al. | 313/495 |
| 2004/0104668 | A1 * | 6/2004 | Lee et al. | 313/496 |
| 2004/0160161 | A1 * | 8/2004 | Song et al. | 313/495 |

* cited by examiner

*Primary Examiner*—Toan Ton
*Assistant Examiner*—Bumsuk Won
(74) *Attorney, Agent, or Firm*—Robert E. Bushnell, Esq.

(57) ABSTRACT

A field emission device and a field emission display using the same. The field emission device includes a concave cathode electrode and an emitter formed at a center thereof. A gate electrode and a focusing gate electrode above the gate electrode serve to focus and refocus the electron beam emanating from the emitter to produce a better focused electron beam leading to improved color purity.

24 Claims, 13 Drawing Sheets

FIELD EMISSION DEVICE AND FIELD EMISSION DISPLAY USING THE SAME HAVING A CONCAVE-SHAPED CATHODE TO ENHANCE ELECTRON FOCUSING

CLAIM OF PRIORITY

This application makes reference to, incorporates the same herein, and claims all benefits accruing under 35 U.S.C. § 119 from an application for FIELD EMISSION DEVICE AND DISPLAY ADOPTING THE SAME earlier filed in the Korean Intellectual Property Office on 4 Aug., 2004 and there duly assigned Serial No. 10-2004-0061422.

BACKGROUND OF THE INVENTION

1. Field of the Invention

The present invention relates to a field emission device and a field emission display using the same having increased ability to focus electron beams.

2. Description of the Related Art

Displays play an important role in information and media delivery and are widely used in personal computer monitors and television sets. Displays are usually either cathode ray tubes (CRTs), which use high speed thermal electron emission or flat panel displays, which are rapidly developing. Types of flat panel displays include plasma display panels (PDPs), field emission displays (FEDs), liquid crystal displays (LCDs) and others.

In FEDs, when a strong electric field is applied between a gate electrode and field emitters arranged at a predetermined distance on a cathode electrode, electrons are emitted from the field emitters and collide with fluorescent materials on the anode electrode, thus producing visible light. FEDs are thin displays, at most several centimeters thick, having a wide viewing angle, low power consumption, and low production cost. Thus, FEDs together with PDPs attract attention as the next generation of displays.

FEDs have a similar physical operation principle to that of CRTs. Specifically, electrons emitted from a cathode electrode are accelerated and collide with an anode electrode. At the anode electrode, the electrons excite fluorescent material coated on the anode electrode to produce visible light. FEDs are different from CRTs in that the electron emitters are made of cold cathode material.

One main challenge with FEDs is to properly focus and properly control the trajectories of the electron beams emanating from the field emitters so that they land at the proper location on the fluorescent material found on the anode. Improper focus and improper control of the trajectories will cause the beams of electrons to land elsewhere and thus produce a poor image. Attempts to improve control over electron trajectories include adding a focusing gate insulating layer and a focusing gate electrode on top of the gate electrode and applying voltages to the focusing gate electrode. This was attempted in U.S. Pat. No. 5,920,151 to Barton et al where an embedded focusing structure is employed. However, the focusing gate electrode in Barton is formed on an organic material, polyimide, which requires an outgassing process for discharging volatilized gas. As a result, such an FED structure cannot be easily applied to large displays. What is therefore needed is a design for an FED that not only properly focuses the electron beams, but can also be used in large displays.

SUMMARY OF THE INVENTION

It is therefore an object of the present invention to provide an improved design for a field emission device and a field emission display using the field emission device.

It is also an object of the present invention to provide a field emission device that provides good focusing of the electron beams and a field emission display using the field emission device.

It is further an object of the present invention to provide a field emission device that can be used in large displays and a field emission display using the field emission device.

These and other objects can be achieved by a field emission device that includes a substrate, a first cathode electrode arranged on the substrate, a first insulating layer arranged on the substrate and on the first cathode electrode and including a concave aperture exposing an exposed portion of the first cathode electrode, a second cathode electrode arranged on the first insulating layer and electrically connected to the first cathode electrode, a plurality of electron emitters arranged on the exposed portion of the first cathode electrode, a gate insulating layer arranged on the second cathode electrode and including an aperture exposing the concave aperture in the first insulating layer, and a gate electrode arranged on the gate insulating layer and including an aperture aligned with the aperture in the gate insulating layer.

The concave aperture in the first insulating layer has a hemispherical shape. The field emission device may further include an amorphous silicon layer arranged between the second cathode electrode and the gate insulating layer and including an aperture that is aligned with the exposed portion of the first cathode electrode. The plurality of electron emitters can be carbon nanotube (CNT) emitters. The first cathode electrode can be made out of a transparent electrode material, and the exposed portion of the first cathode electrode can have a circular shape. The first insulating layer can include a plurality of concave apertures exposing a corresponding plurality of exposed portions of the first cathode electrode.

According to another aspect of the present invention, there is provided a field emission device that includes a substrate, a first cathode electrode arranged on the substrate, a first insulating layer arranged on the substrate and on the first cathode electrode and including a concave aperture exposing an exposed portion of the first cathode electrode, a second cathode electrode arranged on the first insulating layer and electrically connected to the first cathode electrode, a plurality of electron emitters arranged on the exposed portion of the first cathode electrode, a gate insulating layer arranged on the second cathode electrode and including an aperture exposing the concave aperture in the first insulating layer, a gate electrode arranged on the gate insulating layer and including an aperture aligned with the aperture in the gate insulating layer, a focusing gate insulating layer arranged on the gate electrode and including an aperture exposing the aperture in the gate insulating layer, and a focusing gate electrode arranged on the focusing gate insulating layer and including an aperture that is aligned with the aperture in the gate insulating layer According to still another aspect of the present invention, there is provided a field emission display that includes a rear substrate, a first cathode electrode arranged on the rear substrate, a first insulating layer arranged on the rear substrate and on the first cathode electrode and including a concave aperture exposing an exposed portion of the first cathode electrode, a second cathode electrode arranged on the first insulating layer and electrically connected to the first cathode electrode, a plurality of electron emitters arranged on the exposed portion of the first cathode electrode, a gate insulating layer arranged on the second cathode electrode and including an aperture exposing the concave aperture in the first insulating layer, a gate electrode arranged on the gate insulating layer and including an aperture aligned with the aperture in the gate insulating layer, a front substrate separated from the rear substrate, an anode electrode arranged on a surface of the front substrate that faces the plurality of electron emitters, and a fluorescent layer arranged on the anode electrode.

According to yet another aspect of the present invention, there is provided a field emission display that includes a rear substrate, a first cathode electrode arranged on the rear substrate, a first insulating layer arranged on the rear substrate and on the first cathode electrode and including a concave aperture exposing an exposed portion of the first cathode electrode, a second cathode electrode arranged on the first insulating layer and electrically connected to the first cathode electrode, a plurality of electron emitters arranged on the exposed portion of the first cathode electrode, a gate insulating layer arranged on the second cathode electrode and including an aperture exposing the concave aperture in the first insulating layer, a gate electrode arranged on the gate insulating layer and including an aperture aligned with the aperture in the gate insulating layer, a focusing gate insulating layer arranged on the gate electrode and including an aperture exposing the aperture in the gate insulating layer, a focusing gate electrode arranged on the focusing gate insulating layer and including an aperture that is aligned with the aperture in the gate insulating layer, a front substrate separated from the rear substrate, an anode electrode arranged on a surface of the front substrate that faces the plurality of electron emitters, and a fluorescent layer arranged on the anode electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
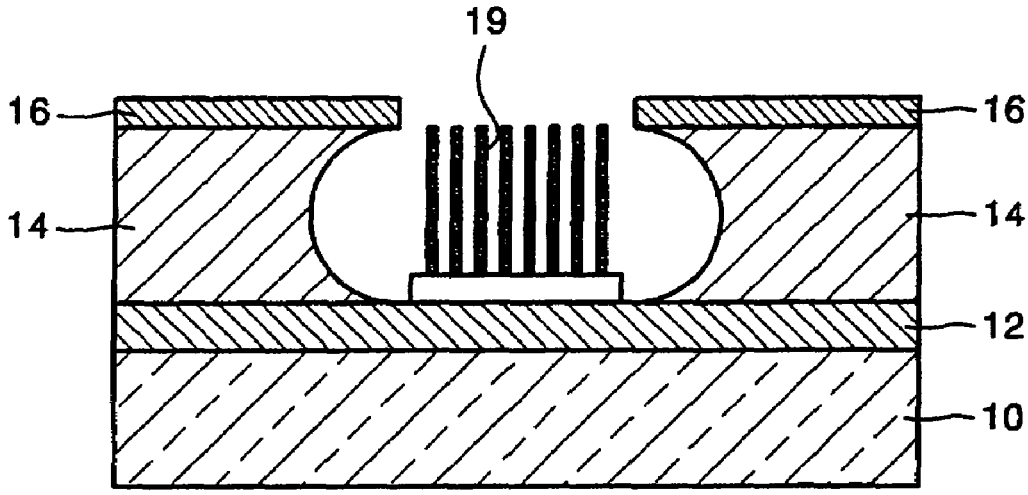
FIG. 1 is a schematic cross-sectional view of the structure of a field emission device.

Turning now to the figures, FIG. 1 is a view of a field emission device. In the FED of FIG. 1, a cathode electrode 12 which is formed on a bottom substrate 10, and a gate electrode 16 is formed on an insulating layer 14, the gate electrode serves to extract electrons. Electron emitters 19 are placed within an aperture through which a portion of the cathode electrode 12 is exposed. In the field emission device of FIG. 1, the trajectories of electron beams are not properly controlled, the desired portion of the fluorescent layer cannot be excited, and thus the desired colors cannot be displayed. There is thus a need for a technique to control the trajectories of the electron beams so that the electrons emitted from the electron emitters 19 can be correctly transferred to the desired portion of the fluorescent material coated on the anode electrode.

Figure 2:
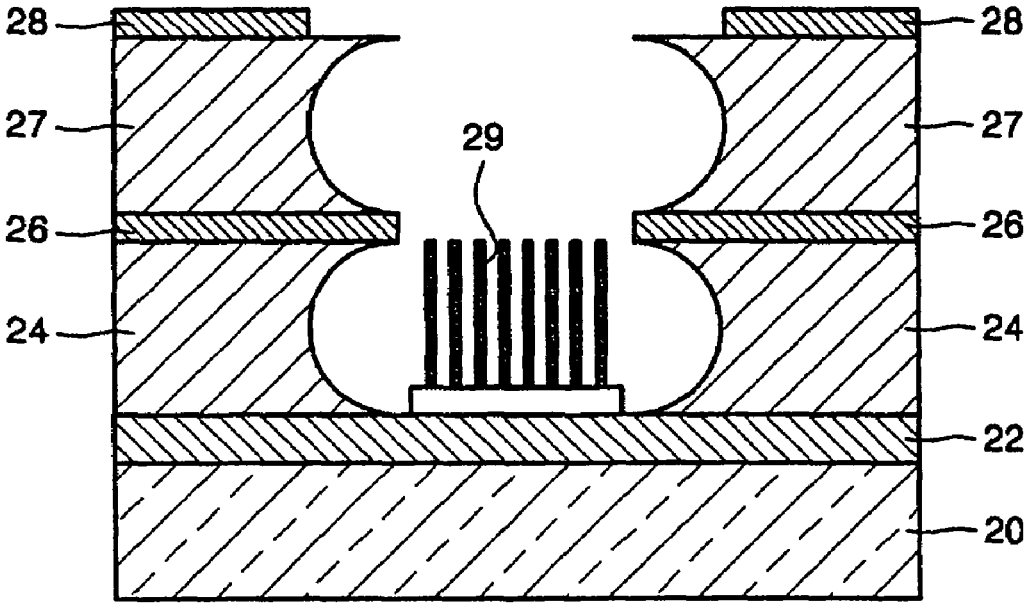
FIG. 2 is a schematic cross-sectional view of the structure of a field emission device having a focusing gate electrode.

Turning now to FIG. 2, FIG. 2 is a view illustrating a field emission device having a focusing gate electrode 28 for controlling the trajectories of electron beams. Referring to FIG. 2, a second insulating layer 27 is deposited on a gate electrode 26, and a focusing gate electrode 28 for controlling the trajectories of electron beams is formed on the second insulating layer 27. Reference numerals 20, 22, 24, and 29 represent a substrate, a cathode electrode, a first insulating layer, and electron emitters, respectively.

Figure 3:
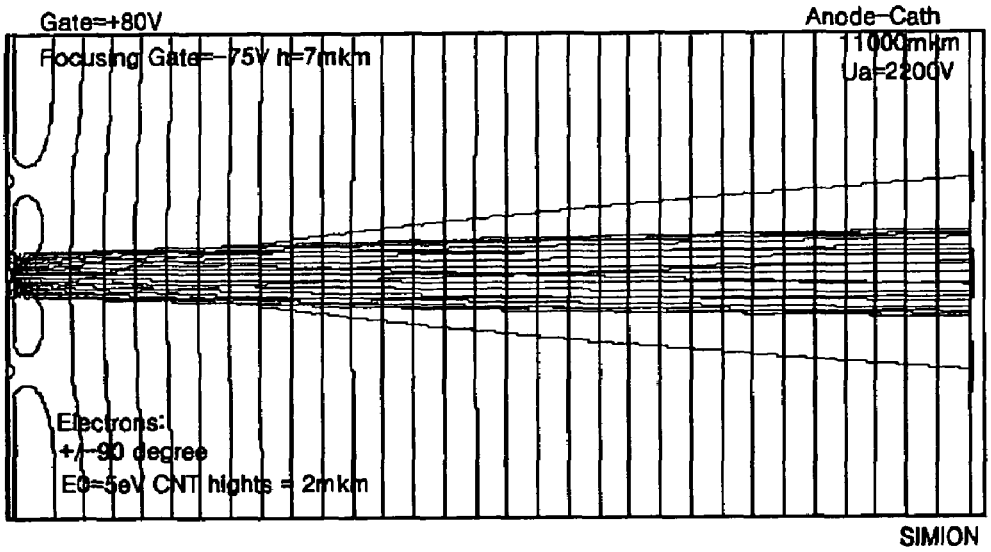
FIG. 3 is a simulation of the trajectories of electron beams emitted from electron emitters in the field emission device of FIG. 2.

Turning now to FIG. 3, FIG. 3 is a simulation of the trajectories of the electron beams emitted from the electron emitters 29 of the field emission device having the focusing gate electrode 28 as illustrated in FIG. 2. As illustrated in FIG. 3, the electron beams are overfocused and thus deviate from the intended region of the fluorescent layer and excite other regions of the fluorescent layer, resulting in reduced color purity.

Figure 4:
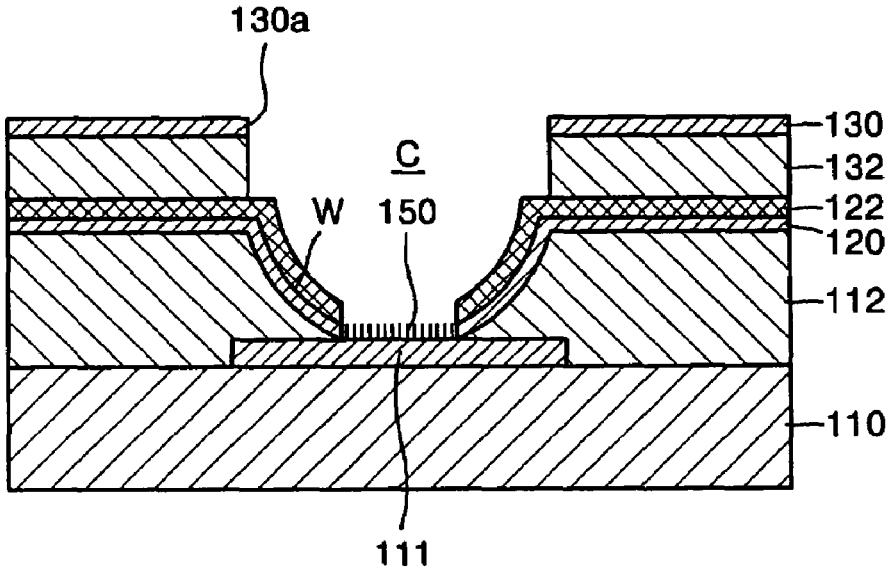
FIG. 4 is a schematic cross-sectional view of a field emission device according to an embodiment of the present invention.

Turning now to FIG. 4, FIG. 4 is a schematic cross-sectional view of a field emission device according to an embodiment of the present invention. Referring to FIG. 4, a first cathode electrode 111 and a first insulating layer 112, such a silicon oxide layer, covering a portion of the first cathode electrode 111 are formed on a glass substrate 110. The first insulating layer 112 has a concave aperture W, which can be hemispherical in shape, and the first cathode electrode 111 is exposed at the center of the concave aperture W. A second cathode electrode 120 is formed on the first insulating layer 112 such that the second cathode electrode 120 is electrically connected to the first cathode electrode 111.

The first insulating layer 112 causes the second cathode electrode 120 to have the concave shape in aperture W. The first insulating layer 112 can have a thickness of 2 to 10 μm. The first cathode electrode 111 and the second cathode electrode 120 can be transparent electrodes, such as ITO (indium tin oxide) electrodes. An amorphous silicon layer 122 is formed on the second cathode electrode 120. The amorphous silicon layer 122 ensures a uniform current flow through the first cathode electrode 111 and the second cathode electrode 120. In addition, the amorphous silicon layer 122 has optical properties that allow visible light to pass but not ultraviolet (UV) light. The amorphous silicon layer 122 serves as a photolithography mask in a back exposure to UV light, which will be described below. CNT (carbon nanotube) emitters 150 used as electron emitters are formed on the exposed portion of the first cathode electrode 111.

A gate insulating layer 132 and a gate electrode 130 are sequentially layered on the amorphous silicon layer 122. The gate insulating layer 132 has an aperture C of a predetermined diameter. The gate electrode 130 has a gate aperture 130*a* corresponding to the aperture C. The gate insulating layer 132 is a layer for maintaining electrical insulation between the gate electrode 130 and the second cathode electrode 120. The gate insulating layer 132 is made of an insulating material, such as silicon oxide ($SiO_2$), and generally has a thickness of about 5 to 10 μm. The gate electrode 130 can be made of chromium with a thickness of about 0.25 μm. The gate electrode 130 extracts electron beams from the CNT emitters 150. A predetermined gate voltage, for example 80 V, can be applied to the gate electrode 130.

The exposed portion of first cathode electrode 111 can have a circular shape, for example, an ITO circle, corresponding to the aperture C and concave aperture W. Alternatively, the first cathode electrode 111 can correspond to a region including a plurality of apertures C, for example, a sub-pixel region of the display.

Figure 5:
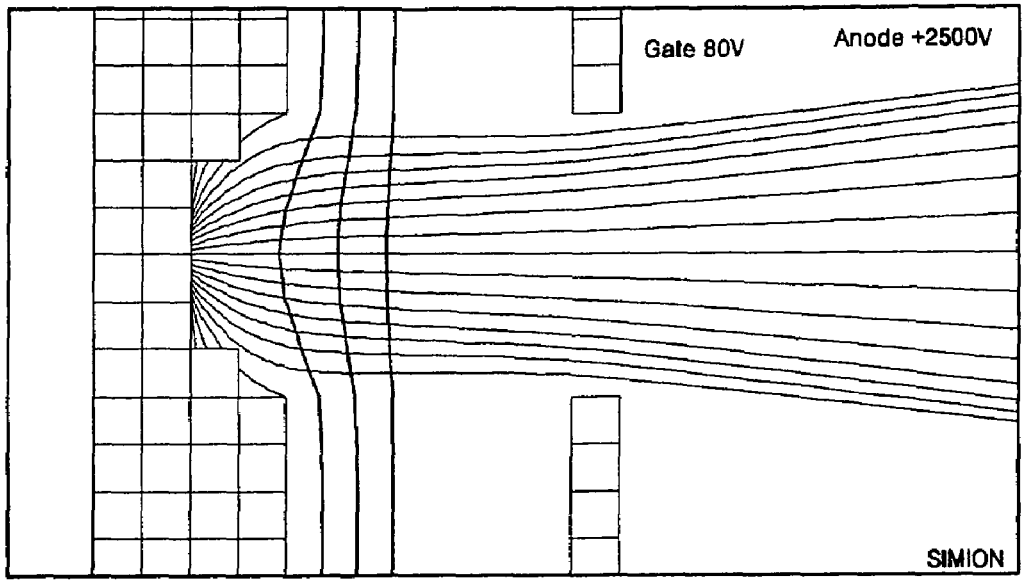
FIG. 5 is a simulation of the trajectories of electron beams emitted from electron emitters in the field emission device of FIG. 4.

Turning now to FIG. 5, FIG. 5 is a simulation of the trajectories of electron beams emitted from electron emitters 150 in the field emission device illustrated in FIG. 4. Referring to FIG. 5, the electron beams are focused before they escape from the gate electrode 130.

Figure 6:
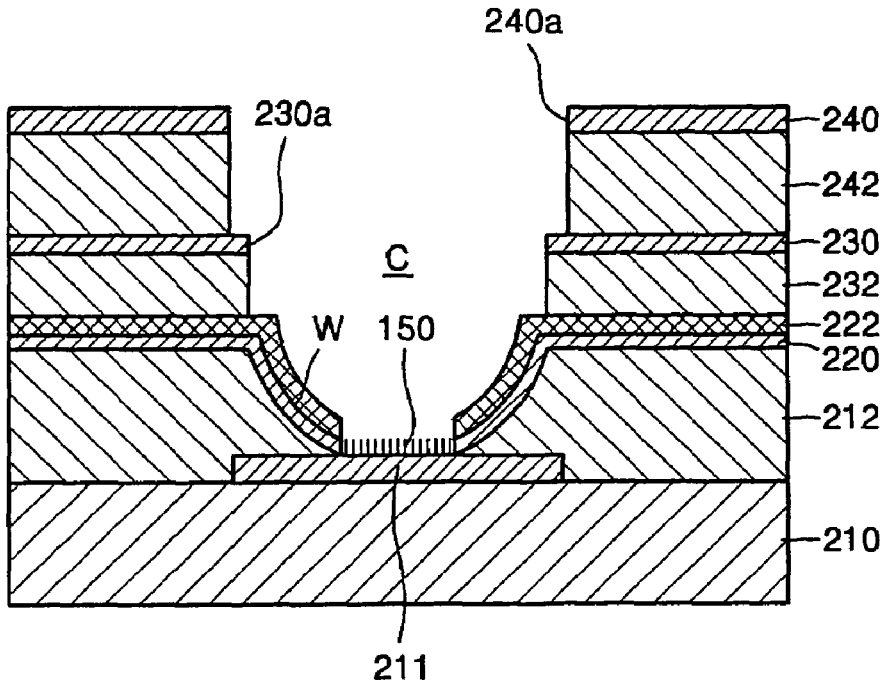
FIG. 6 is a schematic cross-sectional view of a field emission device according to another embodiment of the present invention.

Turning now to FIG. 6, FIG. 6 is a schematic cross-sectional view of a field emission device according to another embodiment of the present invention. Referring to FIG. 6, a first cathode electrode 211 and a first insulating layer 212, such a silicon oxide layer covering a portion of the first cathode electrode 211, are formed on a glass substrate 210. The first insulating layer 212 has a concave aperture W, which can be hemispherical in shape, and the first cathode electrode 211 is exposed at the center of the concave aperture W. A second cathode electrode 220 is formed on the first insulating layer 212 such that the second cathode electrode 220 is electrically connected to the first cathode electrode 211. The first insulating layer 212 causes the second cathode electrode 220 to have the concave hemispherical shape. The first insulating layer 212 can have a thickness of 2 to 10 μm.

The first cathode electrode 211 and the second cathode electrode 220 can be ITO transparent electrodes. An amorphous silicon layer 222 is formed on the second cathode electrode 220. The amorphous silicon layer 222 ensures a uniform current flow through the first cathode electrode 211 and the second cathode electrode 220. In addition, the amorphous silicon layer 222 has optical properties that allow visible light to pass, but not UV light. The amorphous silicon layer 222 serves as a mask in a back exposure to UV light, which will be described below. CNT (carbon nanotube) emitters 250 used as electron emitters are formed on the exposed portion of the first cathode electrode 211.

A gate insulating layer 232, a gate electrode 230, a focusing gate insulating layer 242, and a focusing gate electrode 240 are sequentially layered on the amorphous silicon layer 222. The gate insulating layer 232 and the focusing gate insulating layer 242 have an aperture C. The gate electrode 230 has a gate aperture 230*a* corresponding to the aperture C. The focusing gate electrode 240 has a focusing gate aperture 240*a* corresponding to the aperture C.

The gate insulating layer 232 is a layer that maintains electrical insulation between the gate electrode 230 and the second cathode electrode 220. The gate insulating layer 232 is made of an insulating material, such as silicon oxide ($SiO_2$), and generally has a thickness of about 5 to 10 μm. The gate electrode 230 can be made of chromium with a thickness of about 0.25 μm. The gate electrode 230 extracts electron beams from the CNT emitters 250. A predetermined gate voltage, for example 80 V, can be applied to the gate electrode 230.

The focusing gate insulating layer 242 is a layer for insulating the gate electrode 230 from the focusing gate electrode 240. The focusing gate insulating layer 242 can be made of a silicon oxide ($SiO_2$) with a thickness of 2-15 μm. The focusing gate electrode 240 can be made of chromium with a thickness of about 0.25 μm. The focusing gate electrode 240 is supplied with a voltage lower than that applied to the gate electrode 230, and further focuses the electron beams emitted from the CNT emitters 250.

The exposed portion of the first cathode electrode 211 can have a circular shape, for example, an ITO circle, corresponding to the aperture C and concave aperture W. Alternatively, the first cathode electrode 211 can correspond to a region including a plurality of apertures C, for example, a sub-pixel region of the display.

Figure 7:
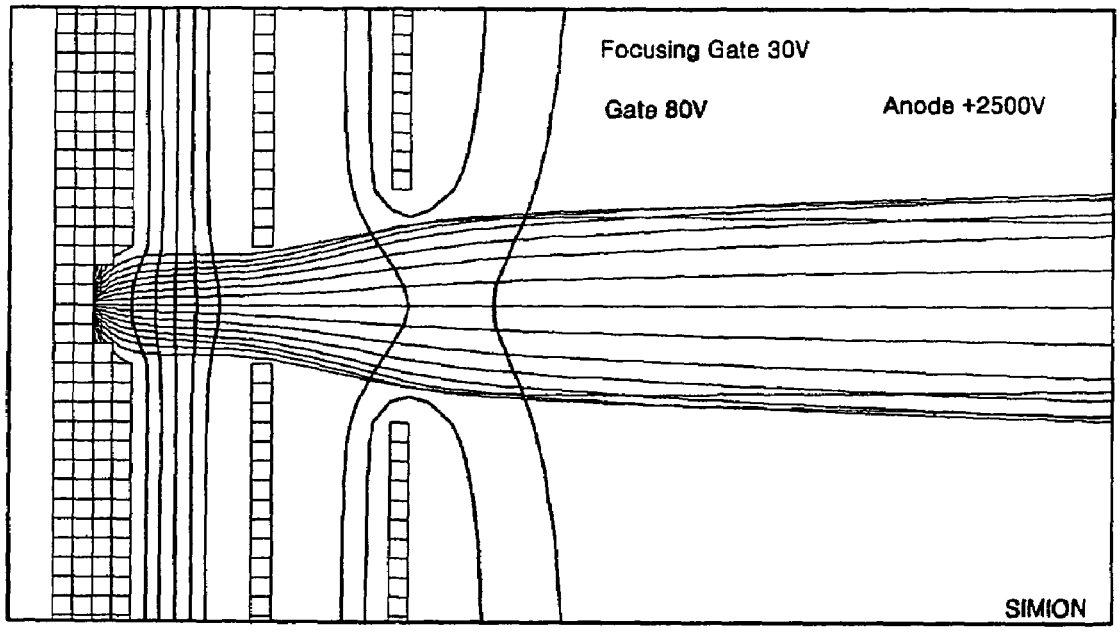
FIG. 7 is a simulation of the trajectories of electron beams emitted from electron emitters in the field emission device of FIG. 6.

Turning now to FIG. 7, FIG. 7 is a simulation of the trajectories of electron beams emitted from electron emitters 150 in the field emission device of FIG. 6. Referring to FIG. 7, the electron beams are focused before they pass through the gate electrode 230 and again focused while escaping from the focusing gate electrode 240.

Figure 8:
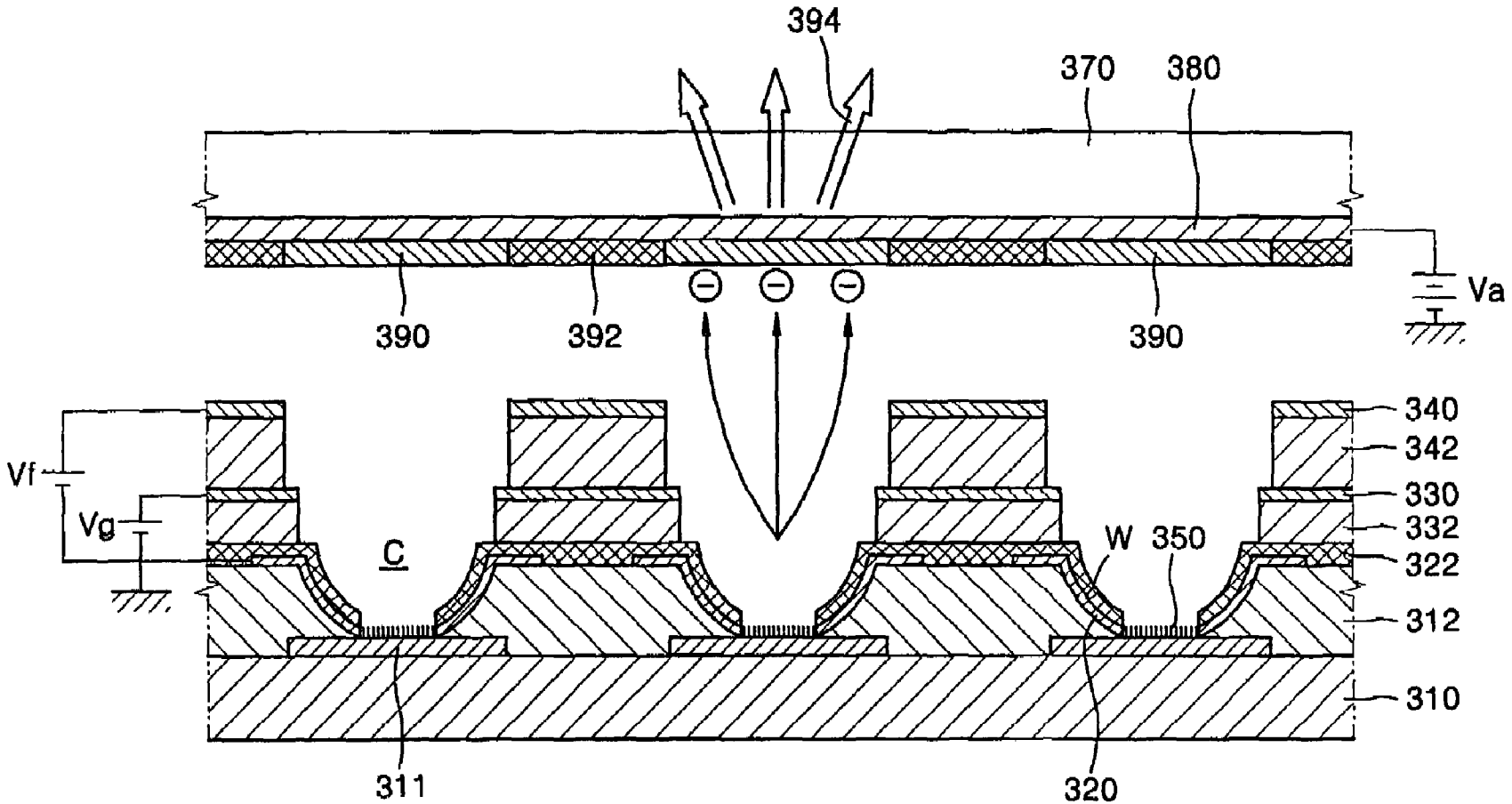
FIG. 8 is a schematic cross-sectional view of the structure of a field emission display according to still another embodiment of the present invention.

Turning now to FIG. 8, FIG. 8 is a schematic cross-sectional view of the structure of a field emission display according to still another embodiment of the present invention. Some constituent elements that are substantially identical to those illustrated in FIG. 6 are referred to by the same name and will not be described again in detail.

Referring now to FIG. 8, the field emission display includes a front substrate 370 and a rear substrate 310 spaced apart from each other by a predetermined distance. A spacer (not shown) is provided between the front substrate 370 and the rear substrate 310 to hold the predetermined distance. The front substrate 370 and the rear substrate 310 can be made of glass.

A field emitting portion is formed on the rear substrate 310, and a light emitting portion is formed on the front substrate 370. The electrons emitted from the field emitting portion cause light to be emitted from the light emitting portion.

Specifically, a first cathode electrode 311 and a first insulating layer 312, such a silicon oxide layer, covering a portion of the first cathode electrode 311 are formed on the rear substrate 310. The first insulating layer 312 has a concave aperture W, which can be hemispherical in shape, and the first cathode electrode 311 is exposed at the center of the concave aperture W. A second cathode electrode 320 is formed on the first insulating layer 312 such that the second cathode electrode 320 is electrically connected to the first cathode electrode 311. A plurality of the second cathode electrodes 320 are arranged in parallel at predetermined intervals and in a predetermined pattern, for example, in a striped pattern.

An amorphous silicon layer 322 is formed on the first insulating layer 312 and exposes the first cathode electrode 311. A gate insulating layer 332, a gate electrode 330, a focusing gate insulating layer 342, and a focusing gate electrode 340 are sequentially formed on the amorphous silicon layer 322, exposing a predetermined cavity C. Electron emitters, for example, CNT emitters 350, are formed on the exposed portion of the first cathode electrode 311.

The exposed portion of the first cathode electrode 311 can have a circular chape, for example, an ITO circle, corresponding to one of the apertures C or one of the concave apertures W. Alternatively, the first cathode electrode 311 can correspond to a region including a plurality of apertures C, for example, a sub-pixel region of the display or one stripe of the second cathode electrode 320.

An anode electrode 380 is formed on the front substrate 370, and a fluorescent layer 390 is coated on the anode electrode 380. A black matrix 392 for increasing color purity is located on the anode electrode 380 between the fluorescent layers 390.

Now, the operation of a field emission display having the above structure will be described in detail with reference to FIG. 8. An anode voltage Va, of 2.5 kV pulses is applied to the anode electrode 380, a gate voltage Vg of 80 V is applied to the gate electrode 330, and a focusing gate voltage Vf of 30 V is applied to the focusing gate electrode 340. At this time, electrons are emitted from the CNT emitters 350 due to the gate voltage Vg. The emitted electrons are focused before escaping the gate electrode 330 due to the concave shape of the second cathode electrode 320, and are again focused due to the focusing gate voltage Vf. Because the electron beams are focused, the focused electrons excite the fluorescent layer 390 at the desired location. Thus, the fluorescent layer 390 emits a predetermined visible light 394.

Figure 9:
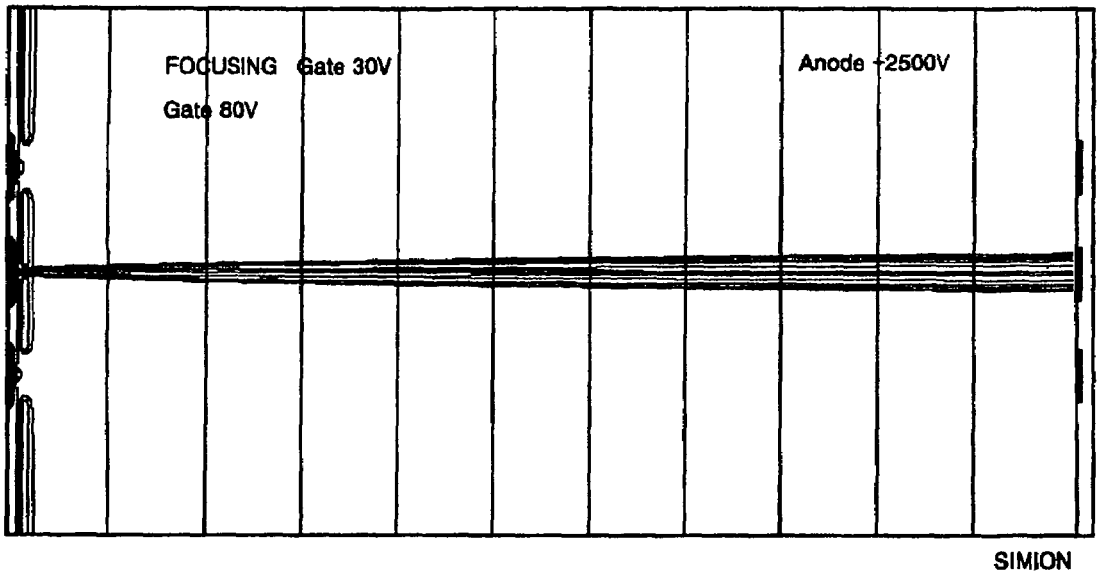
FIG. 9 is a simulation of the trajectories of electron beams emitted from electron emitters in the field emission display of FIG. 8.

Turning now to FIG. 9, FIG. 9 is a simulation of the trajectories of electron beams emitted from electron emitters 350 in the field emission display of FIG. 8. Referring to FIG. 9, it can be seen that the electron beams emitted from the field emission device according to the embodiment of FIG. 8 are focused and thus land on the desired pixel on the anode electrode 380. Thus, the field emission display of FIG. 8 using the field emission device according to the present invention can provide improved color purity.

Figure 10:
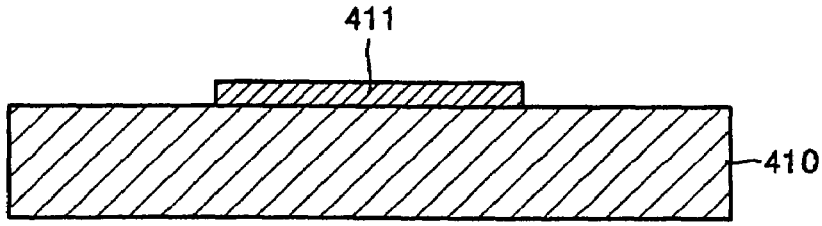
FIGS. 10 through 23 are cross-sectional views illustrating a process of producing the field emission device of FIG. 6 according to an embodiment of the present invention.

Next, the process of producing the field emission device of FIG. 6 according to a further embodiment of the present invention will now be described in detail with reference to FIGS. 10 through 23. Referring now to FIG. 10, a first cathode electrode 411, for example, a circle made of ITO material, is formed on a glass substrate 410.

Figure 11:
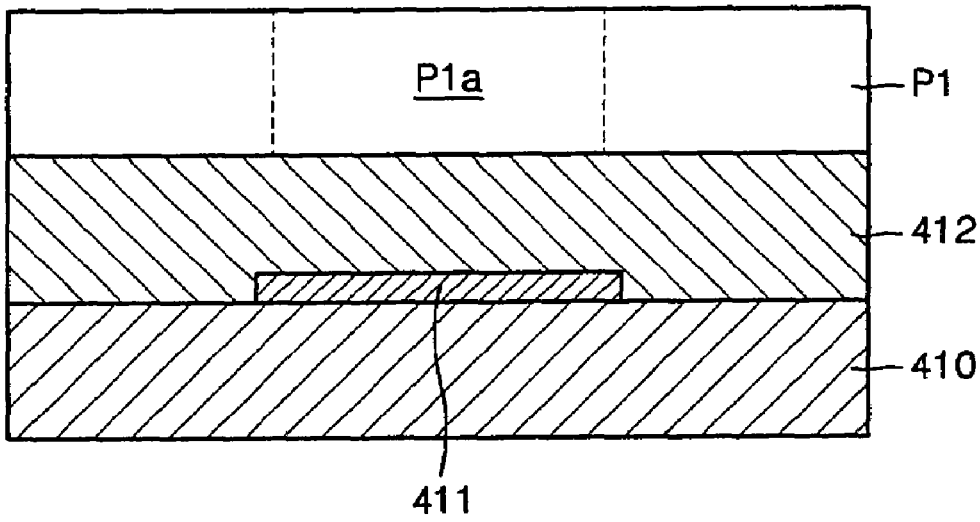
Figure 12:
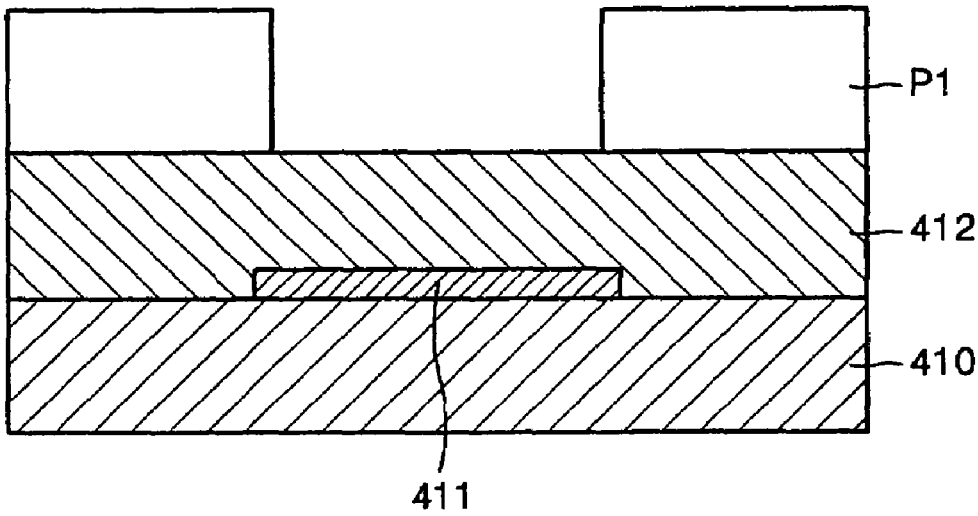

Referring now to FIG. 11, a silicon oxide layer is formed to a thickness of 6 μm as a first insulating layer 412 on the glass substrate 410 and on first cathode electrode 411 via PECVD (plasma enhanced chemical vapor deposition). Then, a first photoresist film P1 is coated on the first insulating layer 412, and the first photoresist film P1 is exposed to UV light. Front exposure or back exposure can be performed by using a mask (not shown). UV light enters a portion P1 a corresponding to the concave aperture (W as illustrated in FIG. 6) of the first photoresist film P1. That is, only a region P1 a located on the top of the concave aperture W of the first photoresist film P1 is exposed to UV light. The exposed region P1*a* is removed via a developing operation. Then, baking is performed. FIG. 12 illustrates the product of the above developing and baking operations. A portion of the first insulating layer 412 is exposed upon the removed region P1*a*.

Figure 13:
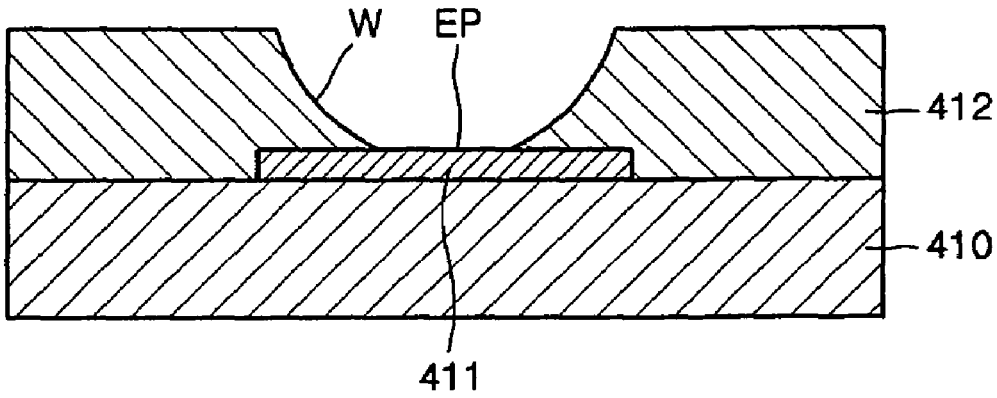

Turning now to FIG. 13, wet etching is performed on the exposed portion of first insulating layer 412 using the first photoresist film P1 as an etch mask, thus forming a hemispherical concave aperture W or well exposing a portion of cathode electrode 411. Then, the patterned first photoresist film P1 is removed. The location of the exposed portion EP corresponds to that of the CNT emitters (150 as illustrated in FIG. 6). The exposed portion EP has a diameter of at least about 3 μm.

Figure 14:
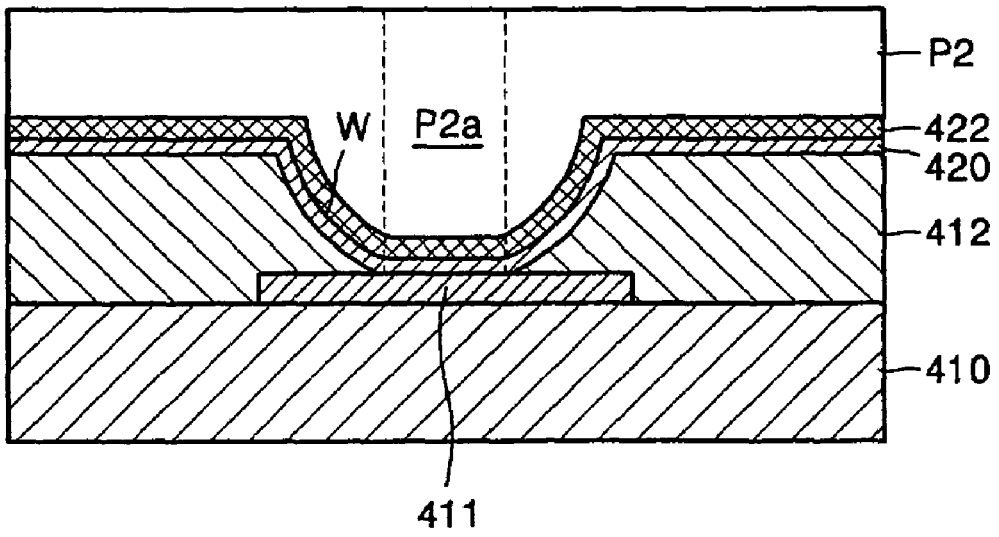

Turning now to FIG. 14, a second cathode electrode 420 made of ITO is formed on the first insulating layer 412 by sputtering. Then, an amorphous silicon layer 422 is formed on the second cathode electrode 420 using PECVD. Then, a second photoresist film P2 is coated on the amorphous silicon layer 422, and region P2*a* corresponding the exposed portion EP is exposed to light.

Figure 15:
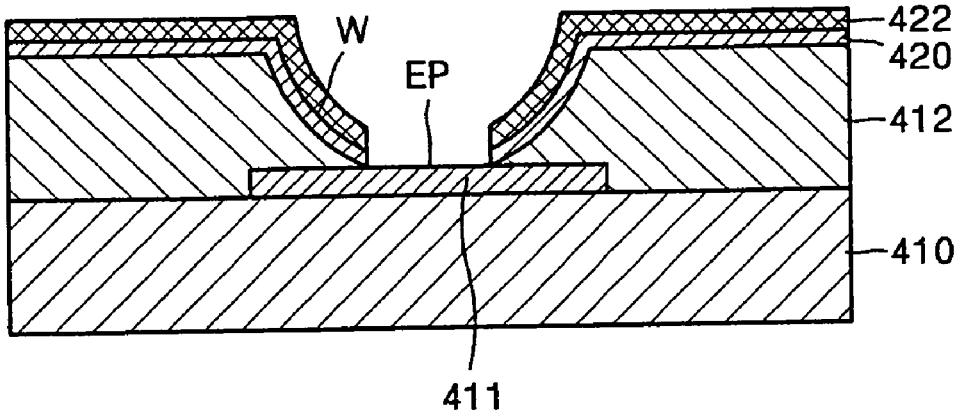

The exposed region P2*a* is removed by developing. A portion of the amorphous silicon layer 422 is exposed when region P2*a* is removed by developing. Wet etching is performed on the exposed portion of the amorphous silicon layer 422 using the second photoresist film P2 as an etch mask exposing a portion of second cathode electrode 420. Wet etching is now performed on the exposed portion of the second cathode electrode 420 again using the second photoresist film P2 as an etch mask. FIG. 15 illustrates the result after both wet etches and after the patterned second photoresist film P2 is removed. As can be seen in FIG. 15, the wet etches have again revealed the exposed portion EP of first cathode electrode 411.

Figure 16:
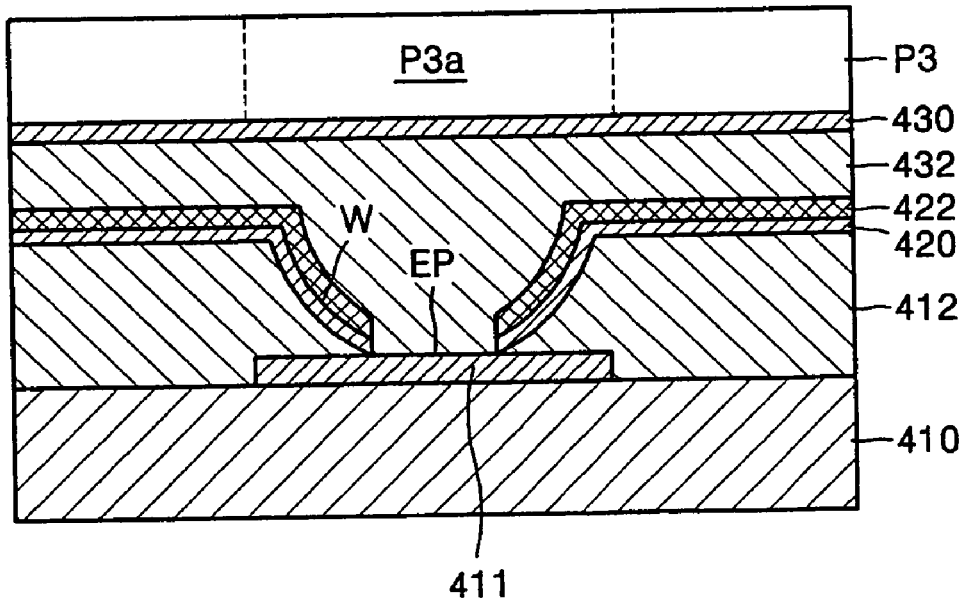

Turning now to FIG. 16, a gate insulating layer 432 is formed on the amorphous silicon layer 422 filling the concave aperture W. The gate insulating layer 432 is made of a silicon oxide with a thickness of about 5 to 10 μm. Then, a gate electrode 430 is formed on the gate insulating layer 432. The gate electrode 430 having a thickness of about 0.25 μm and made of chromium is applied by sputtering. Next, a third photoresist film P3 is formed on the gate electrode 430, and region P3*a* corresponding to the concave aperture W is exposed to light.

Figure 17:
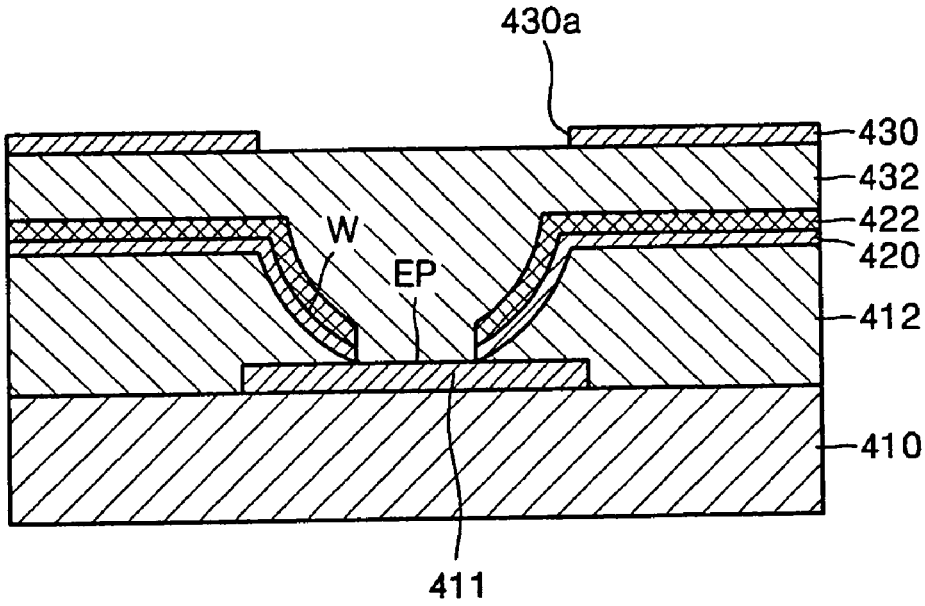

Subsequently, the exposed region P3*a* is removed by developing, revealing an exposed portion of gate electrode 430. Wet etching is then performed on the exposed portion of the gate electrode 430 using the patterned third photoresist film P3 as an etch mask. FIG. 17 illustrates the result after the wet etching and after the patterned third photoresist film P3 is removed. As illustrated in FIG. 17, a gate aperture 430*a* is now present in gate electrode 430 exposing a portion of the gate insulating layer 432.

Figure 18:
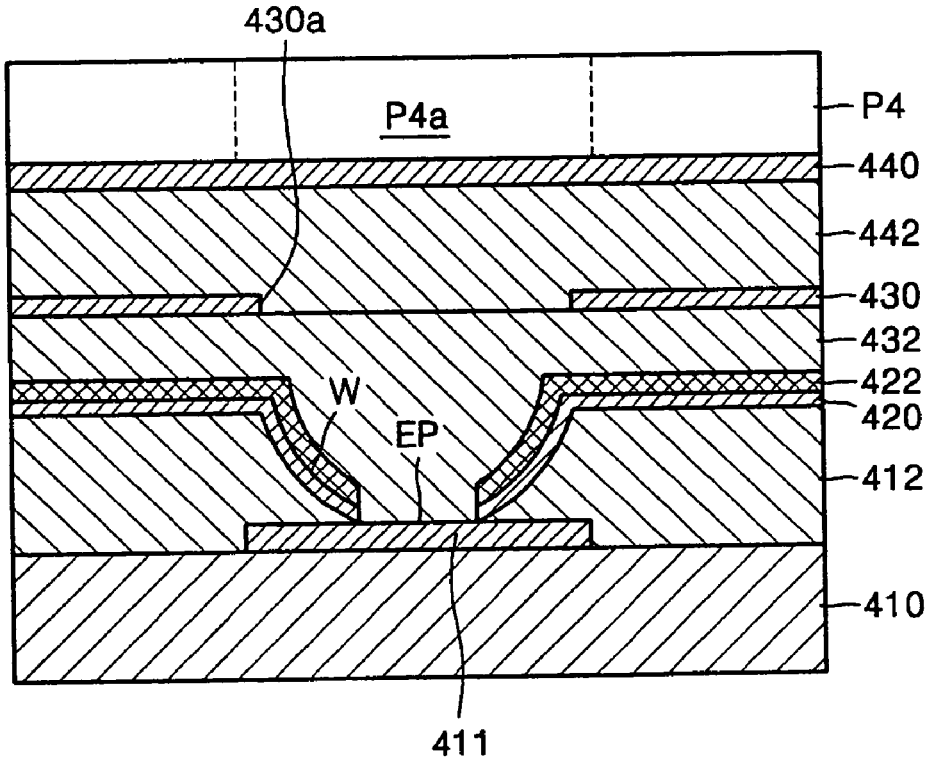

Turning now to FIG. 18, after removal of the third photoresist film P3, a focusing gate insulating layer 442 is formed on the patterned gate electrode 430 and on the exposed portion of gate insulating layer 432 thus filling the gate aperture 430*a*. The focusing gate insulating layer 442 is made of a silicon oxide with a thickness of about 2 to 15 μm. Then, a focusing gate electrode 440 is formed on the focusing gate insulating layer 442. The focusing gate electrode 440 is about 0.25 μm of chromium applied by sputtering.

Figure 19:
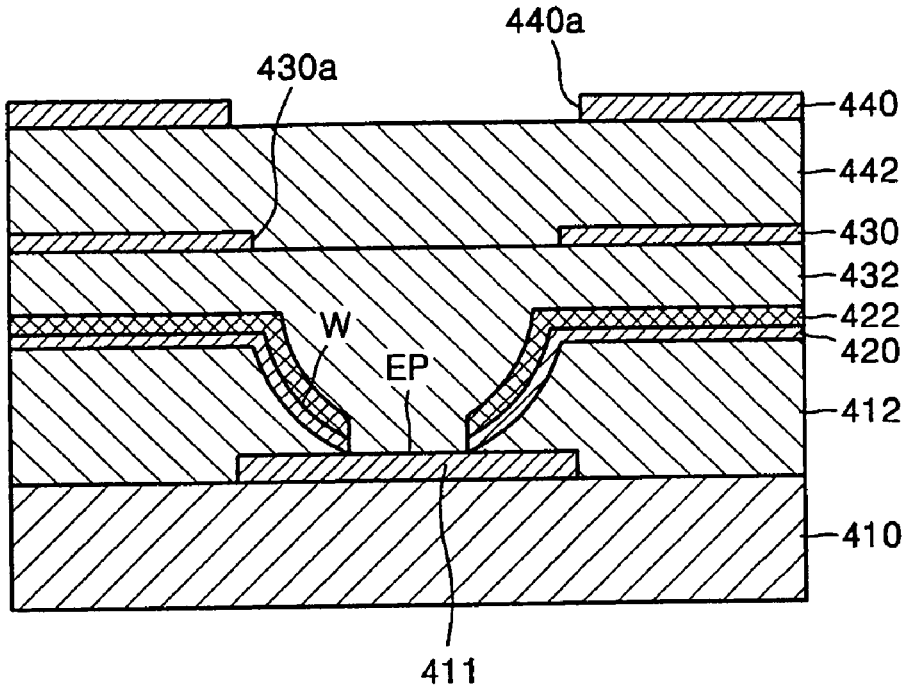

Next, a fourth photoresist film P4 is formed on the focusing gate electrode 440 and region P4*a* corresponding to the concave aperture W is exposed to light. Subsequently, the exposed region P4*a* is removed by developing. A portion of the focusing gate electrode 440 is exposed via the removed region P4*a*. Wet etching is performed on the exposed portion of the focusing gate electrode 440 using the fourth photoresist film P4 as an etch mask. FIG. 19 illustrates the result after the wet etching of the exposed portion of focusing gate electrode 440 and after the patterned fourth photoresist film P4 is removed. As illustrated in FIG. 19, focusing gate electrode 440 now has a focusing gate aperture 440*a*.

Figure 20:
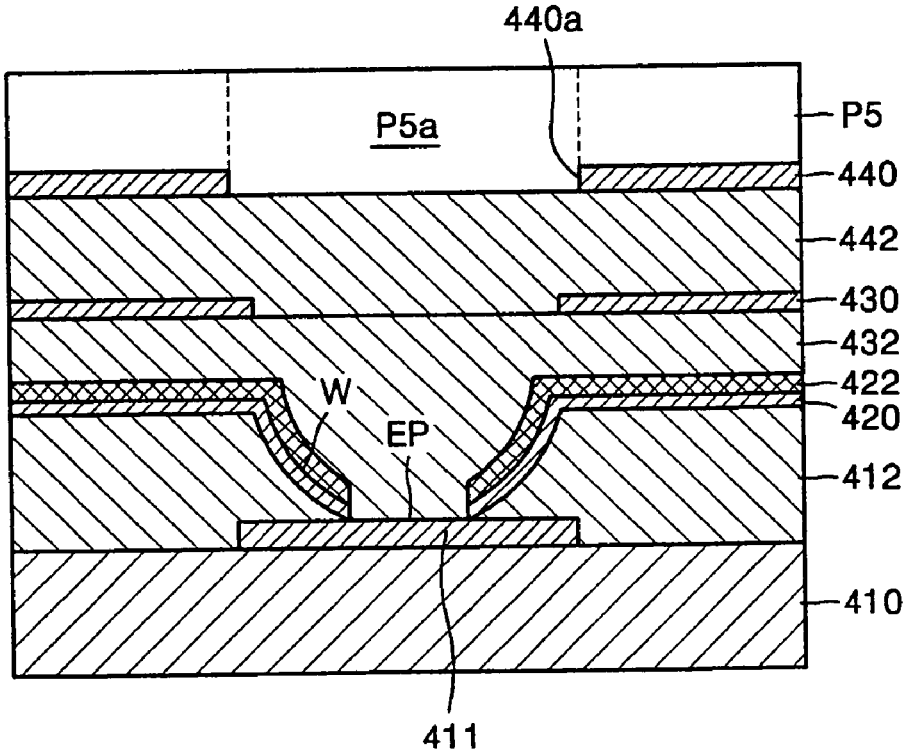
Figure 21:
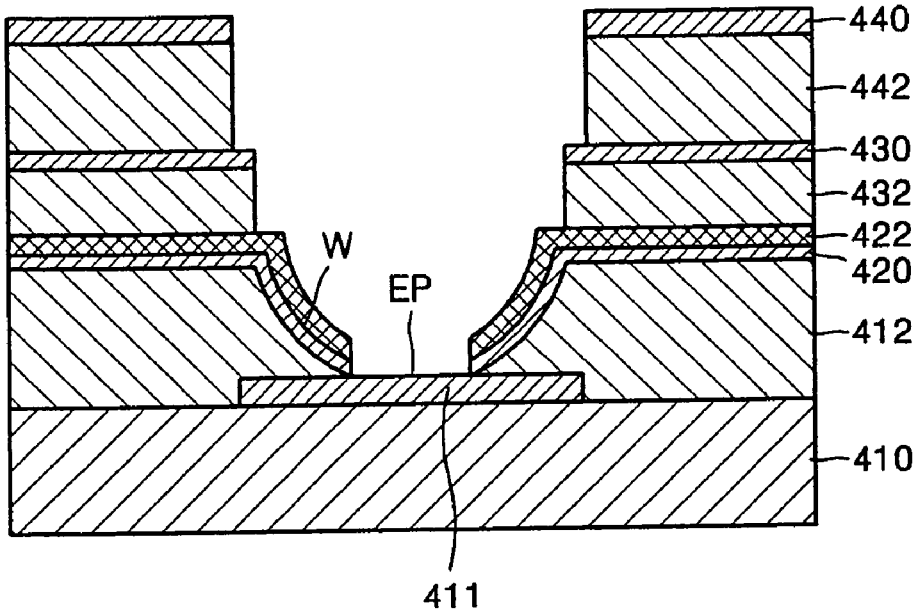

Turning now to FIG. 20, a fifth photoresist film P5 is then coated on the patterned focusing gate electrode 440. Then, region P5*a* corresponding to the concave aperture W is exposed to light. Subsequently, the exposed region P5*a* is removed by developing. Wet etching is then performed on the exposed portion of focusing gate insulating layer 442 and the underlying portion of the gate insulating layer 432 using the fifth photoresist film P5 as an etch mask, to expose the concave aperture W of the cathode electrode 420 and also to expose exposed portion EP of first cathode electrode 411. FIG. 21 illustrates the result after the focusing gate insulating layer 442 the gate insulating layer 432 have been etched and after the patterned fifth photoresist film P5 has been removed.

Figure 22:
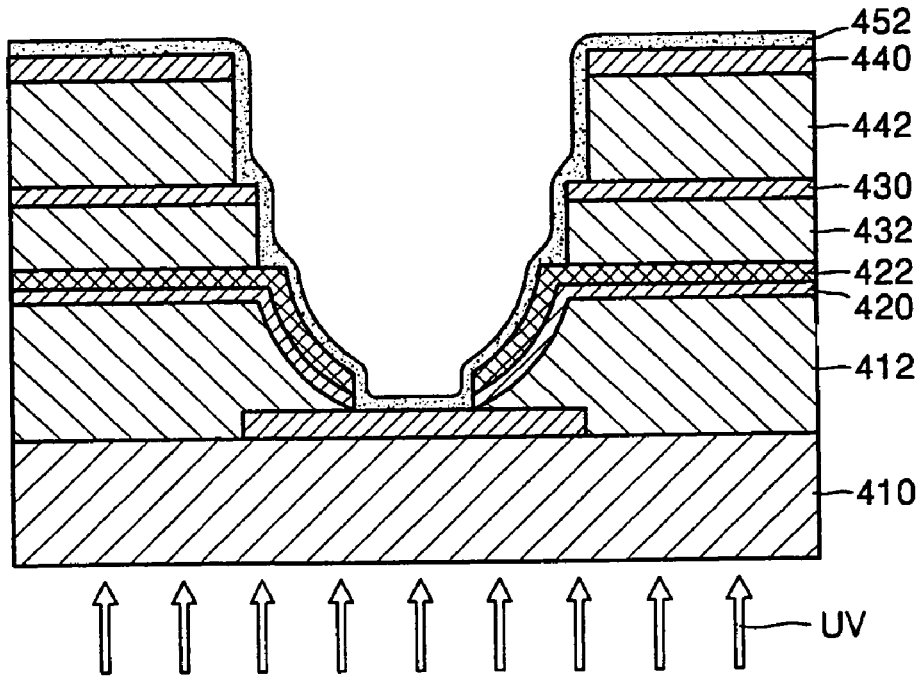
Figure 23:
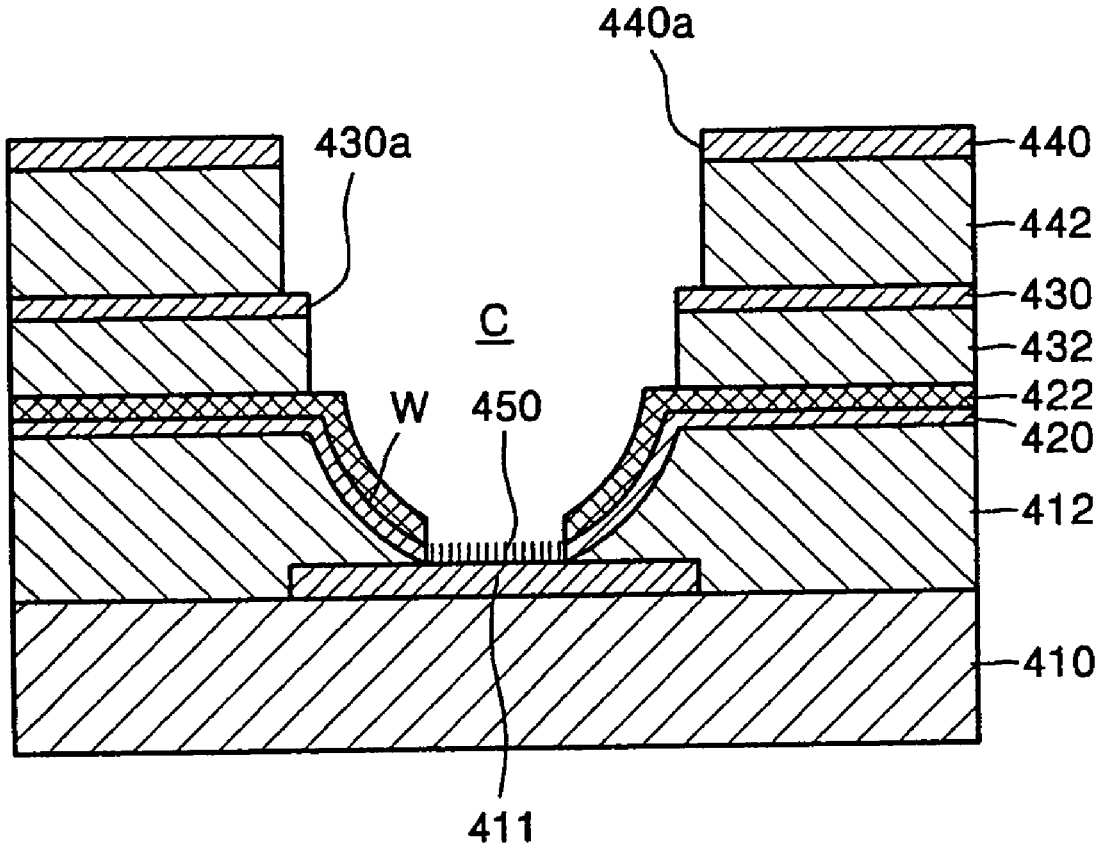

Turning now to FIG. 22, a CNT paste 452 containing a negative photosensitive substance is coated on the second cathode electrode 420, the exposed portion EP of the first cathode electrode 411 and on the rest of the structure. Then the photosensitive CNT paste 452 is exposed to UV light using the patterned amorphous silicon layer 422 as an exposure mask. Back exposure can be performed by irradiating the UV light toward the substrate 410 from below. Since the amorphous silicon layer 422 blocks UV light, only the CNT paste formed on the exposed portion EP of the first cathode electrode 411 is exposed to the UV light. Then, CNT emitters 450 are formed on the exposed portion EP of the first cathode electrode 411 through developing and baking operations, resulting in the final structure of FIG. 23.

The above process of producing the field emission device produces the embodiment illustrated in FIG. 6. The field emission device of the embodiment illustrated in FIG. 4 can be produced by an equivalent process, but omitting the forming the focusing gate insulating layer and the focusing gate electrode.

In the embodiments of the present invention, the CNT emitters are formed using a printing method, but are not limited thereto. For example, the CNT can be grown by forming a catalytic metal layer on the exposed portion EP of the first cathode electrode 411 and then depositing a carbon containing gas, such as methane gas, to the catalytic metal layer.

As described above, in the field emission device according to the present invention, the first insulating layer has a concave aperture W surrounding CNT emitters, and thus, an electron beam emitted from the CNT emitters is focused before exiting the gate aperture, thus improving the focus of the electron beam. The result is a field emission device with improved color purity.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission device, comprising:

a substrate;

a first cathode electrode arranged on the substrate;

a first insulating layer arranged on the substrate and on the first cathode electrode and including a concave aperture having a concave-shaped sidewall profile, the concave aperture exposing an exposed portion of the first cathode electrode;

a second cathode electrode arranged on the first insulating layer and within the concave aperture of the first insulating layer and being electrically connected to the first cathode electrode;

a plurality of electron emitters arranged on the exposed portion of the first cathode electrode;

a gate insulating layer arranged on the second cathode electrode and including an aperture exposing the concave aperture in the first insulating layer; and a gate electrode arranged on the gate insulating layer and including an aperture aligned with the aperture in the gate insulating layer.

2. The field emission device of claim 1, wherein the concave aperture in the first insulating layer has a hemispherical shape.

3. The field emission device of claim 1, further comprising an amorphous silicon layer arranged between the second cathode electrode and the gate insulating layer and including an aperture that is aligned with the exposed portion of the first cathode electrode.

4. The field emission device of claim 1, wherein the plurality of electron emitters are carbon nanotube (CNT) emitters.

5. The field emission device of claim 1, the first cathode electrode comprising a transparent electrode material, the exposed portion of the first cathode electrode has a circular shape.

6. The field emission device of claim 1, wherein the first insulating layer includes a plurality of concave apertures exposing a corresponding plurality of exposed portions of the first cathode electrode.

7. The field emission display of claim 1, the second cathode electrode having a hemispherical-shaped sidewall profile within the concave aperture of the first insulating layer.

8. A field emission device, comprising:

a substrate;

a first cathode electrode arranged on the substrate;

a first insulating layer arranged on the substrate and on the first cathode electrode and including a concave aperture having a concave sidewall parofile and exposing an exposed portion of the first cathode electrode;

a second cathode electrode arranged on the first insulating layer and having a concave sidewall profile within the concave aperture and being electrically connected to the first cathode electrode;

a plurality of electron emitters arranged on the exposed portion of the first cathode electrode;

a gate insulating layer arranged on the second cathode electrode and including an aperture exposing the concave aperture in the first insulating layer;

a gate electrode arranged on the gate insulating layer and including an aperture aligned with the aperture in the gate insulating layer;

a focusing gate insulating layer arranged on the gate electrode and including an aperture exposing the aperture in the gate insulating layer; and a focusing gate electrode arranged on the focusing gate insulating layer and including an aperture that is aligned with the aperture in the gate insulating layer.

9. The field emission device of claim 8, wherein the concave aperture in the first insulating layer has a hemispherical shape.

10. The field emission device of claim 8, further comprising an amorphous silicon layer arranged between the second cathode electrode and the gate insulating layer and including an aperture that is aligned with the exposed portion of the first cathode electrode.

11. The field emission device of claim 8, wherein the plurality of electron emitters are carbon nanotube (CNT) emitters.

12. The field emission device of claim 8, the first cathode electrode comprising a transparent electrode material, the exposed portion of the first cathode electrode has a circular shape.

13. The field emission device of claim 8, wherein the first insulating layer includes a plurality of concave apertures exposing a corresponding plurality of exposed portions of the first cathode electrode.

14. A field emission display, comprising:

a rear substrate;

a first cathode electrode arranged on the rear substrate;

a first insulating layer arranged on the rear substrate and on the first cathode electrode and including a concave aperture exposing an exposed portion of the first cathode electrode;

a second cathode electrode arranged on the first insulating layer and having a concave shape within the concave aperture and being electrically connected to the first cathode electrode within the concave aperture;

a plurality of electron emitters arranged on the exposed portion of the first cathode electrode;

a gate insulating layer arranged on the second cathode electrode and including an aperture exposing the concave aperture in the first insulating layer;

a gate electrode arranged on the gate insulating layer and including an aperture aligned with the aperture in the gate insulating layer;

a front substrate separated from the rear substrate;

an anode electrode arranged on a surface of the front substrate that faces the plurality of electron emitters; and a fluorescent layer arranged on the anode electrode.

15. The field emission display of claim 14, wherein the concave aperture in the first insulating layer has a hemispherical shape.

16. The field emission display of claim 14, further comprising an amorphous silicon layer arranged between the second cathode electrode and the gate insulating layer and including an aperture that is aligned with the exposed portion of the first cathode electrode.

17. The field emission display of claim 14, wherein the plurality of electron emitters are carbon nanotube (CNT) emitters.

18. The field emission display of claim 14, the first cathode electrode comprising a transparent electrode material, the exposed portion of the first cathode electrode has a circular shape.

19. The field emission display of claim 14, wherein the first insulating layer includes a plurality of concave apertures exposing a corresponding plurality of exposed portions of the first cathode electrode.

20. A field emission display, comprising:

a rear substrate;

a first cathode electrode arranged on the rear substrate;

a first insulating layer arranged on the rear substrate and on the first cathode electrode and including a concave aperture exposing an exposed portion of the first cathode electrode, wherein the concave aperture in the first insulating layer has a hemispherical shape;

a second cathode electrode arranged on the first insulating layer and electrically connected to the first cathode electrode;

a plurality of electron emitters arranged on the exposed portion of the first cathode electrode;

a gate insulating layer arranged on the second cathode electrode and including an aperture exposing the concave aperture in the first insulating layer;

a gate electrode arranged on the gate insulating layer and including an aperture aligned with the aperture in the gate insulating layer;

a focusing gate insulating layer arranged on the gate electrode and including an aperture exposing the aperture in the gate insulating layer;

a focusing gate electrode arranged on the focusing gate insulating layer and including an aperture that is aligned with the aperture in the gate insulating layer;

a front substrate separated from the rear substrate;

an anode electrode arranged on a surface of the front substrate that faces the plurality of electron emitters; and a fluorescent layer arranged on the anode electrode.

21. The field emission display of claim 20, further comprising an amorphous silicon layer arranged between the second cathode electrode and the gate insulating layer and including an aperture that is aligned with the exposed portion of the first cathode electrode.

22. The field emission display of claim 20, wherein the plurality of electron emitters are carbon nanotube (CNT) emitters.

23. The field emission display of claim 20, the first cathode electrode comprising a transparent electrode material, the exposed portion of the first cathode electrode has a circular shape.

24. The field emission display of claim 20, wherein the first insulating layer includes a plurality of concave apertures exposing a corresponding plurality of exposed portions of the first cathode electrode.

* * * * *